US010762757B2

(12) United States Patent
Testanero et al.

(10) Patent No.: US 10,762,757 B2
(45) **Date of Patent: *Sep. 1, 2020**

(54) TRACK AND TRACE DEVICE, SYSTEMS AND METHODS THEREOF

(71) Applicant: Cellotape, Inc., Newark, CA (US)

(72) Inventors: Nick Testanero, Torrington, CT (US); Larry Tadashi Ino, Santa Clara, CA (US); Timothy J. Daly, Cape Coral, FL (US)

(73) Assignee: Cellotape, Inc., Newark, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/412,592

(22) Filed: May 15, 2019

(65) Prior Publication Data

US 2019/0266865 A1 Aug. 29, 2019

Related U.S. Application Data

(63) Continuation of application No. 15/099,532, filed on Apr. 14, 2016, now Pat. No. 10,319,203.

(Continued)

(51) Int. Cl.
*G08B 13/24* (2006.01)

(52) U.S. Cl.
CPC ..... *G08B 13/2434* (2013.01); *G08B 13/2417* (2013.01)

(58) Field of Classification Search
CPC ..... G08B 13/2417; G08B 13/2434
See application file for complete search history.

(56) References Cited

U.S. PATENT DOCUMENTS 6,121,544 A * 9/2000 Petsinger ..... G06K 19/005 150/147
6,342,830 B1 1/2002 Want et al.
(Continued)

FOREIGN PATENT DOCUMENTS

EP 2469453 A1 6/2012
JP 2007-052750 A 3/2007
(Continued)

OTHER PUBLICATIONS

Written Opinion and International Search Report for PCT/US2013/065524 dated Feb. 13, 2014.
(Continued)

*Primary Examiner* — Quan-Zhen Wang
*Assistant Examiner* — Rajsheed O Black-Childress
(74) *Attorney, Agent, or Firm* — Waller Lansden Dortch & Davis, LLP; Matthew C. Cox

(57) ABSTRACT

Embodiments of the present invention relates to a track and trace (TT) device. The TT device includes a radio frequency identification (RFID) tag, a near field communication (NFC) tag coupled with the RFID tag, and protective materials to cover the TT device. The RFID tag includes an identifier that is unique among all RFID tags and is, therefore, only associated with a product in which the TT device is embedded in. The NFC tag is pre-encoded with location information of a registration server. To register the product, the registrant uses an NFC-enabled device to access the location information of the registration server and to display thereon a registration page generated by the registration server. The registration page is automatically populated with the unique identifier of the RFID tag. Once registration is completed, an account corresponding to the association of the registrant with the product is created and stored.

15 Claims, 3 Drawing Sheets

Related U.S. Application Data

(60) Provisional application No. 62/148,099, filed on Apr. 15, 2015.

(56) References Cited

U.S. PATENT DOCUMENTS

| | | | |
|---|---|---|---|
| 7,230,539 | B2 | 6/2007 | Klien |
| 8,522,977 | B1 | 9/2013 | Britt, Jr. |
| 9,026,187 | B2 | 5/2015 | Huang |
| 9,048,665 | B2 | 6/2015 | Wojcik et al. |
| 9,083,811 | B2 | 7/2015 | Sharma et al. |
| 9,275,049 | B2 | 3/2016 | de Toro |
| 2006/0017573 | A1 | 1/2006 | Noguchi |
| 2007/0034686 | A1 | 2/2007 | Davis et al. |
| 2007/0109126 | A1 | 5/2007 | House |
| 2008/0238610 | A1 | 10/2008 | Rosenberg |
| 2008/0316033 | A1 | 12/2008 | Yoo et al. |
| 2010/0019482 | A1 | 1/2010 | Kumagai et al. |
| 2011/0070828 | A1 | 3/2011 | Griffin et al. |
| 2011/0070837 | A1 | 3/2011 | Griffin et al. |
| 2011/0285535 | A1 | 11/2011 | Barwin |
| 2011/0320293 | A1 | 12/2011 | Khan |
| 2012/0029997 | A1 | 2/2012 | Khan et al. |
| 2012/0061465 | A1 | 3/2012 | Luo |
| 2012/0075072 | A1 | 3/2012 | Pappu |
| 2012/0123827 | A1 | 5/2012 | Dooley et al. |
| 2012/0209686 | A1 | 8/2012 | Horowitz et al. |
| 2012/0223819 | A1 | 9/2012 | Burgess et al. |
| 2012/0295591 | A1 | 11/2012 | Boudville |
| 2012/0309307 | A1 | 12/2012 | D'Amico |
| 2013/0037608 | A1 | 2/2013 | Eversky |
| 2013/0043302 | A1 | 2/2013 | Powlen et al. |
| 2013/0140358 | A1 | 6/2013 | Graef et al. |
| 2013/0206841 | A1 | 8/2013 | Cairns |
| 2013/0215467 | A1 | 8/2013 | Fein et al. |
| 2013/0225079 | A1 | 8/2013 | Ashour et al. |
| 2013/0227653 | A1* | 8/2013 | Choi ..... H04L 67/02 726/4 |
| 2014/0113549 | A1 | 4/2014 | Beg et al. |
| 2015/0035650 | A1 | 2/2015 | Lind |
| 2015/0134552 | A1* | 5/2015 | Engels ..... G06Q 10/087 705/318 |
| 2016/0093130 | A1 | 3/2016 | Shen et al. |

FOREIGN PATENT DOCUMENTS

| | | | |
|---|---|---|---|
| KR | 10-2012-0065988 | A | 6/2012 |
| KR | 10-1194329 | B1 | 10/2012 |

OTHER PUBLICATIONS

Written Opinion and International Search Report for PCT/US2013/065487 dated May 12, 2015.

Written Opinion and International Search Report for PCT/US2013/022850 dated Jul. 29, 2014.

COMPUCORP, Compucorp & Monroe 300 Series Portable Calculators, 1999; http://www.classiccmp.org/calcmuseum/compucorp_portable.htm.

McFerran, How to use NFC tags, Mar. 2012; http://www.cne.com/howto/howtousenfctagswithyourandroidmobilephone/.

Youtube, how to program an NFC tag, Feb. 2012; https://www.youtube.com/watch?v=9nGs0R8-suQ.

Office Action for U.S. Appl. No. 13/673,674 dated Apr. 1, 2015.

* cited by examiner

TRACK AND TRACE DEVICE, SYSTEMS AND METHODS THEREOF

CROSS-REFERENCES TO RELATED APPLICATIONS

This application is a continuation of U.S. patent application Ser. No. 15/099,532 filed Apr. 14, 2016 entitled TRACK AND TRACE DEVICE, SYSTEMS AND METHODS THEREOF, which claims benefit of U.S. Provisional Patent Application No. 62/148,099, filed Apr. 15, 2015, entitled Track and Trace Device, Systems and Methods Thereof, which are hereby incorporated by reference in their entireties.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention generally relates to anti-theft devices. More specifically, the present invention relates to a track and trace device, which includes a radio frequency identification (RFID) tag and a near field communication (NFC) tag, systems and methods thereof.

Anti-theft devices prevent or deter unauthorized appropriation of goods. New anti-theft devices are desired.

BRIEF SUMMARY

Embodiments of the present invention relates to a track and trace (TT) device. The TT device includes a radio frequency identification (RFID) tag, a near field communication (NFC) tag coupled with the RFID tag, and protective materials to cover the TT device. The RFID tag includes an identifier that is unique among all RFID tags and is, therefore, only associated with a product in which the TT device is embedded in. The NFC tag is pre-encoded with location information of a registration server. To register the product, the registrant uses an NFC-enabled device to access the location information of the registration server and to display thereon a registration page generated by the registration server. The registration page is automatically populated with the unique identifier of the RFID tag. Once registration is completed, an account corresponding to the association of the registrant with the product is created and stored.

In one aspect, a track and trace (TT) device is provided. The TT device includes a near field communication (NFC) tag that is pre-programmed with location information of a registration server, and a radio frequency identification (RFID) tag that includes a unique RFID identifier. The RFID tag is coupled with the NFC tag.

In some embodiments, the TT device further includes a protectant surrounding the NFC tag and the RFID tag.

In some embodiments, the protectant is made of foam. Alternatively or in addition to, the protectant is made from weatherproof material.

In some embodiments, the NFC tag is also pre-programmed with the unique RFID identifier.

In some embodiments, the location information is a URL of the registration server, and the unique RFID identifier is a field of the URL In another aspect, a system is provided. The system includes a track and trace (TT) device. The TT device includes near field communication (NFC) tag that is pre-programmed with location information of a registration server, and a radio frequency identification (RFID) tag that includes a unique RFID identifier. The RFID tag is coupled with the NFC tag. The system also includes a product. The TT device is embedded at a location in the product such that removal of the TT device from the product results in damage to the product.

In some embodiments, the TT device further includes a protectant surrounding the NFC tag and the RFD tag.

In some embodiments, the system further includes a registration server that is configured to create an account associating a registrant of the product with the product by using the unique RFID identifier of the RFID tag of the TT device that is embedded inside the product.

In some embodiments, the system further includes a NFC-enabled device that is configured to read the location information from the NFC tag and automatically display a registration page generated by the registration server associated with the location information.

In some embodiments, the registration page includes a field entry that is automatically populated with the unique RFID identifier of the RFID tag of the TT device that is embedded inside the product. In some embodiments, the field entry is not modifiable.

In some embodiments, the system further includes a reporting server that is configured to store reportings of missing/stolen products.

In some embodiments, the reporting server is configured to retrieve unique RFID identifiers associated with the missing/stolen products from the registration server.

In yet another aspect, a method of providing a track and trace (TT) device is provided. The method includes obtaining a radio frequency identification (RFID) tag. The RFID tag includes a unique RFID identifier. The method also includes obtaining a near field communication (NFC) tag, pre-programming the NFC tag with location information of a registration server, coupling the NFC tag with the RFID tag, and surrounding the NFC tag and the RFID tag with a protectant such that the TT device is able to withstand tampering.

In some embodiments, the protectant is made of foam. Alternatively or in addition to, the protectant is made from weatherproof material.

In some embodiments, the method further includes pre-programming the NFC tag with the unique RFID identifier.

In some embodiments, the method further includes embedding the TT device at a location inside a product such that removal of the TT device from the product results in damage to the product.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

In the following description, numerous details are set forth for purposes of explanation. However, one of ordinary skill in the art will realize that the invention can be practiced without the use of these specific details. Thus, the present invention is not intended to be limited to the embodiments shown but is to be accorded the widest scope consistent with the principles and features described herein.

Figure 1A:
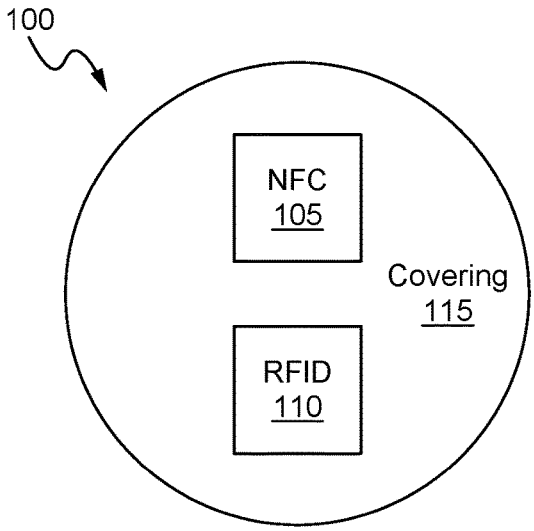
FIG. 1A illustrated an exemplary track and tracke (TT) device according to some embodiments.
Figure 1B:
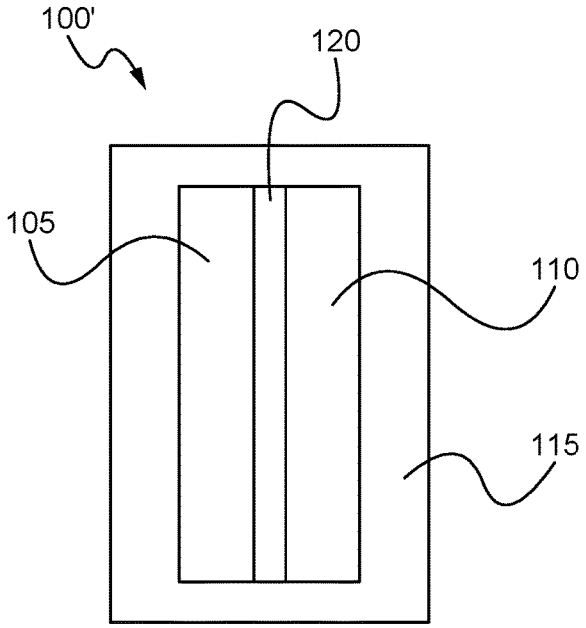
FIG. 1B illustrates an exemplary TT device according to some embodiments.
Figure 1C:
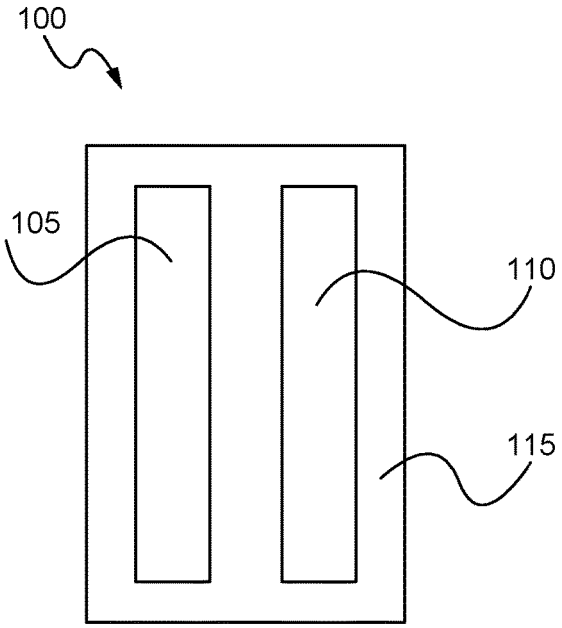
FIG. 1C illustrates an exemplary TT device according to some embodiments.
Figure 2:
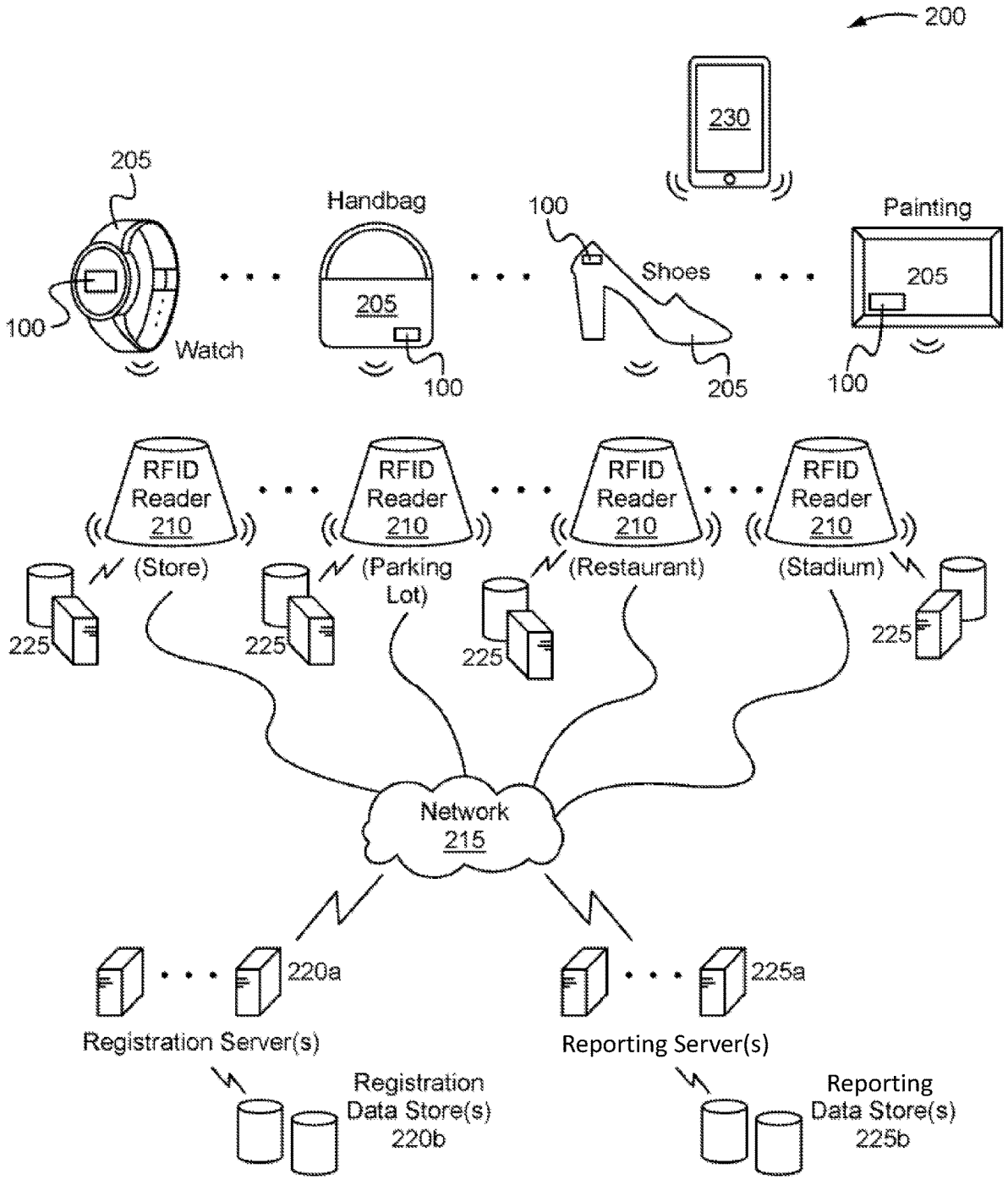
FIG. 2 illustrates an exemplary system according to some embodiments.

FIGS. 1A-1C illustrate an exemplary track and trace (TT) device 100 according to some embodiments. FIG. 2 illustrates an exemplary system 200 according to some embodiments. Referring to FIGS. 1A-2, the TT device 100 is an anti-theft device that can be embedded within a product 205, such as a high value item. The product 205 can be a name-brand handbag or shoe, an expensive watch, a famous painting, a collectible or the like. In some embodiments, the TT device 100 is embedded at a particular location in the product 205 such that removal of the TT device 100 from the product 205 results in damage to the product 205 and/or makes the product 205 unusable, unwearable and/or invaluable. For example, a TT device 100 is embedded in a handle of a briefcase such that removal of the TT device 100 makes the briefcase unusable. For another example, a TT device 100 is embedded in the insole of Jimmy Choo® shoe such that removal of the TT device 100 makes the shoe unwearable. Since removal of an embedded TT device 100 would result in a product 205 being damaged, the TT device 100 prevents or deters the unauthorized appropriation of goods.

The TT device 100 includes a near field communication (NFC) tag 105 and a radio frequency identification (RFID) tag 110. In some embodiments, the NFC tag 105 and the RFID tag 110 are affixed with an adhesive 120, as shown in an exemplary cross-sectional view of the TT device 100 illustrated in FIG. 1B. Alternatively or in addition to, the NFC tag 105 and the RFID tag 110 are protected or surrounded by material(s) 115, such as foam, weatherproof material, such that the TT device 100 has a rugged construction and is able to withstand tampering and different use and environmental conditions. In some embodiments, the NFC tag 105 and the RFID tag 110 are simply held in place within the TT device 110 without an adhesive by the material 115, as shown in an exemplary cross-sectional view of the TT device 100 illustrated in FIG. 1C.

The RFID tag 110 of the TT device 100 inside the product 205 includes an identifier that is unique among all RFID tags and, as such, is only associated with the product 205 in which the TT device 100 is embedded in. The RFID tag 110 of the TT device 100 not only provides authenticity of the product 205 but also enables tracking of the product 205 before and after purchase. Before purchase, the RFID tag 110 allows tracking of the product 205 within a store and prevents the product 205 from being stolen or improperly removed from the store. After purchase, a registrant, such as the purchaser, is able to register the product 205, which thereby creates an association between the purchaser and the product 205, and is also able to report the product 205 as being stolen/missing, if necessary. As explained elsewhere, after the product 205 is reported as being stolen/missing, the reporting will be used to check against RFID tags read by participating RFID readers 210 at public locations such as stores, parking garages, airports, restaurants, stadiums, libraries, etc. When the RFID tag 110 in the stolen/missing product is read by any of the RFID readers 210, authorities, such as the owner of that RFID reader 210 and/or the local police, will be notified that the stolen/missing product 205 is within a vicinity of the RFID reader 210.

The registration of a product 205, such as a watch, is with a registration server(s) 220*a*, which is in communication with a registration data store(s) 220*b*. The NFC tag 105 of the TT device 100 inside the watch 205 is pre-encoded or pre-programmed with location information of the registration server 220*a* (e.g., URL) before the TT device 100 is embedded inside the watch 205. To register the watch 205 with the registration server 220*a*, the purchaser registrant is able to use a NFC-enabled device 230 to access the location information of registration server 220*a* that is pre-programmed in the NFC tag 105 of the TT device 100. The NFC-enabled device 230 thereafter communicates with the registration server 220*a*. The device 230 automatically launches a native web browser using at least the URL to display a registration web page that is generated by the registration server 220*a*. The unique RFID identifier associated with the RFID tag 110 of the TT device 100 is passed from the device 230 to the registration server 220*a*. For example, the NFC tag 105 can also pre-encoded with the unique RFID identifier associated with the RFID tag 110 of the TT device 100 and read by the device 230. Other means of obtaining the unique RFID identifier by the device 230 are also contemplated. For example, the device 230 is coupled with a RFID reader for reading the RFID tag 110. In some embodiments, the unique RFID identifier associated with the RFID tag 110 of the TT device 100 can be added as a URL field. The registration web page is automatically pre-populated with the unique RFID identifier associated with the RFID tag 110 of the TT device 100. In some embodiments, this automatically populated field entry in the registration web page cannot be modified to prevent, for example, miskeying of the identifier. In some embodiments, the purchaser registrant also provides personal information, such as name and contact information, login information, and other information related to the watch (e.g., description of the product) in the registration web page. Once registration is completed, an account corresponding to the association of the purchaser with the unique RFID identifier, and thereby the watch 205, is created and stored in the registration data store 220*b*. In some embodiments, the purchaser registrant is able to access the same account, such as by the login information, to update personal information, login information, description of the watch, and the like. For example, if the watch 205 has a visual mark, such as a blemish, the purchaser registrant can update the account to reflect this information.

In some embodiments, the purchaser registrant is able to access the same account to disassociate the association of the purchaser registrant with the watch 205 such that the account is thereby removed from the registration data store 220*b* to allow for re-registration of the watch 205 by a new registrant. In some embodiments, re-registration of the same product is prevented and cannot occur unless the association of that product with the current registrant is first disassociated. Assume a perpetrator illegitimately scans the TT device 100 in the watch 205 by using their NFC-enabled device in an attempt to register the watch 205. Since the account corresponding to the association of the purchaser registrant with the watch 205 has already been created and stored in the registration data store 220*b*, the registration server 220*a* will generate an improper registration web page on the perpetrator's NFC-enabled device. The registration server 220*a* can keep track of attempted and failed registrations. In some embodiments, this information is provided and viewable by accessing the current registrant's account. An account is removed from the registration data store 220*b* by a party when ownership of a product 205 is being transferred from that party to another party.

The reporting of a product 205 being stolen/missing is with a reporting server(s) 225*a*, which is in communication with a reporting data store(s) 225*b*. In some embodiments, the registration server 220*a* and the reporting server 225*a* are co-located in the same server. The registration server 220*a* and the reporting server 225*a* can be maintained or controlled by the same provider. Alternatively, the registration server 220*a* and the reporting server 225*a* can be maintained or controlled by different providers. In some embodiments, the reporting server 225*a* is a global server that is accessible by the general public or by members of a reporting/anti-theft service. In some embodiments, a reward system(s) can be put in place as an incentive to encourage use of the reporting service. In some embodiments, the reporting service is provided by the provider of the reporting server 225*a*.

Continuing with the example above, to report the watch 205 as being stolen/missing, the purchaser registrant makes a report with the reporting server 225*a*. In some embodiments, the purchaser registrant provides the same personal information that was provided during registration in a reporting web page generated by the reporting server 225*a*. Using the personal information, the reporting server 225*a* automatically performs a search in the registration data store 220*b* to retrieve the corresponding unique RFID identifier that is associated with the personal information. This reporting, which includes the registrant purchaser's personal information and the unique RFID identifier, is stored in the reporting data store 225*b*, among other reportings. The reporting data store 225*b* is updated by users to include new reportings and to remove old reportings.

In some embodiments, the reporting data store 225*b* is periodically synched with local systems 225 participating in the reporting service. Each local system 225 includes a local server and a local data store and is in communication with a RFID reader 210. The local server compares unique RFID identifiers of nearby RFID tags read by the RFID reader 210 with information stored in the local data store. If there is a match, authorities are alerted regarding the stolen/lost product 205. In this scenario, data processing is locally performed on the front-end, thereby reducing network traffic. Alternatively, the RFID readers 210 transmit across the network 215 unique RFID identifiers that are read by the RFID readers 210 to the reporting server 225*a*. The reporting server 225*a* compares the received identifiers with information stored in the reporting data store 225*b*. If there is a match, authorities are alerted regarding the stolen/lost product 205. In this scenario, data processing is remotely performed on the back-end. Once the stolen/missing watch 205 is recovered, the reporting data store 225*b* is updated by removing the corresponding reporting.

Referring to FIG. 2, the system 200 includes the local system(s) 225, the RFID reader(s) 210, the registration server(s) 220*a* and the reporting server(s) 225*a* are coupled with the network(s) 215, including the Internet. The local systems 225 and associated RFID readers 210 can be located at different locations and are in communication with the reporting servers 225*a*. In some embodiments, owners of the local systems 225/RFID readers 210 participate in the reporting/anti-theft service, which allows the local systems 225/RFID readers 210 to communicate with the reporting servers 225*a*. The system 100 also includes goods 205, such as watches, handbags, shoes, artwork, collectibles, etc., that have embedded in them TT devices 100. Each TT device 100 includes a RFID tag 110 and a NFC tag 105. The RFID tag 110 uniquely identifies the product that includes the RFID tag 110 in it. The NFC tag 105 enables the legitimate owner of the product to register the product with the registration server 220*a*. These goods 205 are "smart" products and can be labeled or marketed as such to deter the goods 205 from being stolen.

Figure 3:
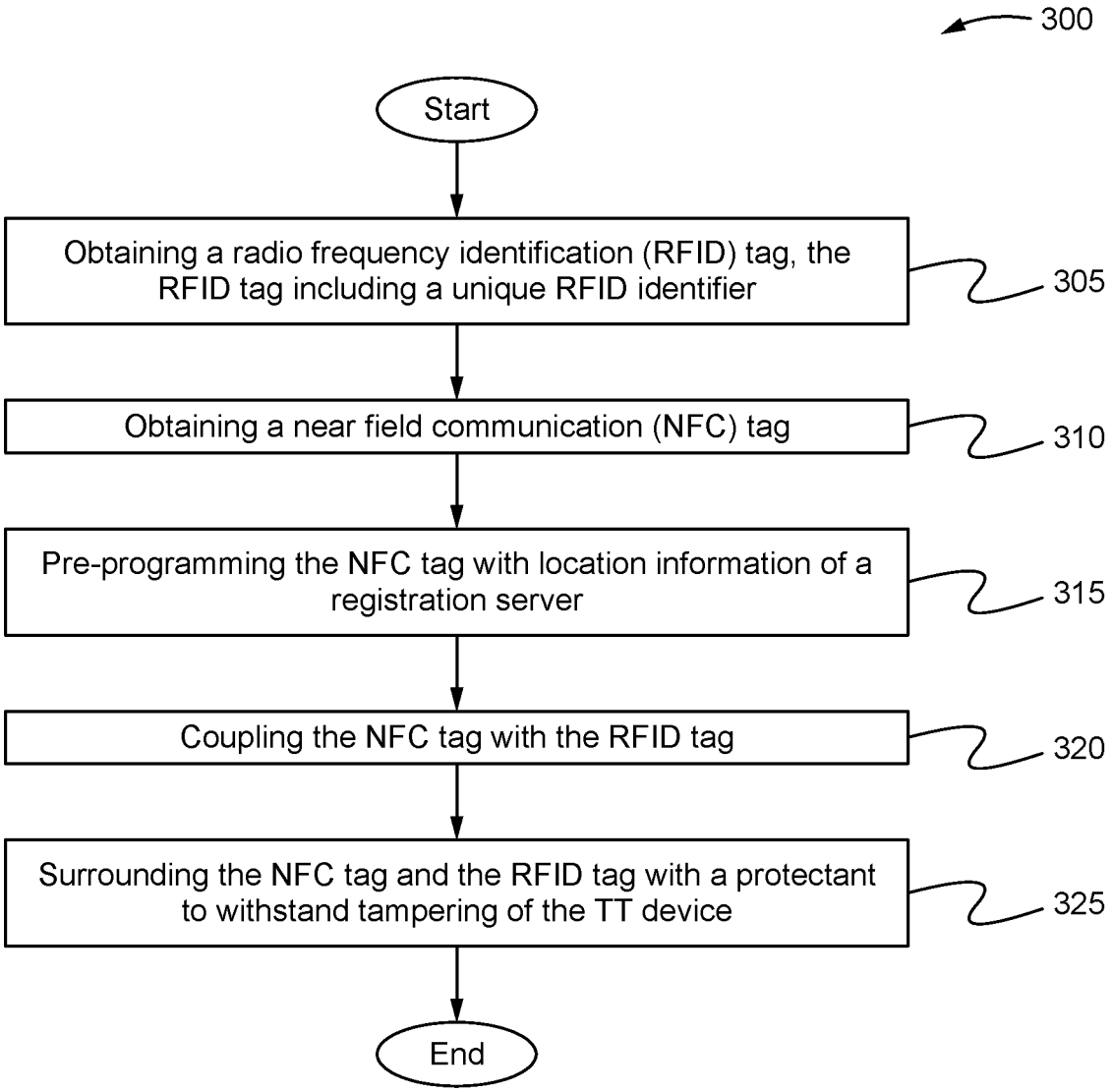
FIG. 3 illustrates an exemplary method of providing a track and trace (TT) device according to some embodiments.

FIG. 3 illustrates an exemplary method 300 of providing a track and trace (TT) device according to some embodiments. The method 300 starts at a Step 305, where a radio frequency identification (RFID) tag is obtained. Typically, the RFID tag include a unique RFID identifier. This identifier is unique among all RFID tags. At a Step 310, a near field communication (NFC) tag is obtained. The NFC tag is blank. In other words, the NFC tag has not yet been programmed. At a Step 315, the NFC tag is pre-programmed with location information of a registration server. The registration server is configured to keep track of registered products. In some embodiments, the NFC tag is also pre-programmed with the unique RFID identifier. At a Step 320, the NFC tag with the RFID tag are coupled. In some embodiments, an adhesive is used to affix the NFC tag and the RFID tag together. At a Step 325, the NFC tag and the RFID tag are surrounded a protectant such that the TT device is able to withstand tampering. In some embodiments, the protectant is made of foam. Alternatively or in addition to, the protectant is made from weatherproof material. After the Step 325, the method 300 ends. The TT device can be embedded at a location inside a product such that removal of the TT device from the product results in damage to the product.

In some embodiments, TT devices are sold to manufacturers to embed in their products. Each TT device can also include a removable barrier or shield to prevent the unauthorized reading of the NFC tag of the corresponding TT device before the TT device is embedded in a product. The barrier can be coupled to the NFC tag side of the TT device or to the RFID tag side of the TT device. In some embodiments, a removable barrier is coupled to each side of the TT device. Before the TT device is embedded inside a product, the barrier(s) is removed. The barrier is typically a metallic sheet, such as a foil sheet. The foil sheet can be silver or any color. In some embodiments, the size of the barrier is at least the size of the NFC tag of the TT device. Alternatively, the size of the barrier is smaller than the size of the NFC tag but covers at least a portion of the NFC tag. The barrier includes a printed image on a surface of the barrier.

In some embodiments, to prevent unauthorized registration of the product before the product is sold at a store, a removable barrier or shield is placed over the TT device on the product to prevent the unauthorized reading of the NFC tag. After the product is purchased, the barrier can be removed from the product by the purchaser. Once the barrier is removed, the NFC tag can be read by an NFC-enable device. This exterior barrier is typically a metallic sheet, such as a foil sheet. The foil sheet can be silver or any color. In some embodiments, the size of the barrier is at least the size of the NFC tag of the TT device. Alternatively, the size of the barrier is smaller than the size of the NFC tag but covers at least a portion of the NFC tag. The barrier includes a printed image on a surface of the barrier. For example, the printed image can include instructions to register the product and to report the product as being stolen/missing.

One of ordinary skill in the art will realize other uses and advantages also exist. While the invention has been described with reference to numerous specific details, one of ordinary skill in the art will recognize that the invention can be embodied in other specific forms without departing from the spirit of the invention. Thus, one of ordinary skill in the art will understand that the invention is not to be limited by the foregoing illustrative details, but rather is to be defined by the appended claims.

Thus, although there have been described particular embodiments of the present invention of a new and useful TRACK AND TRACE DEVICE, SYSTEMS AND METHODS THEREOF, it is not intended that such references be construed as limitations upon the scope of this invention.

What is claimed is:

1. A system, comprising:

a first track and trace (TT) device including a first radio frequency identification (RFID) identifier and location information of a registration server;

a near-field communication (NFC)-enabled device configured to send the first RFID identifier to the registration server using the location information of the first TT device;

the registration server configured to generate and store a first product registration, wherein the first product registration includes an association of the first RFID identifier with a registrant;

a local system including an RFID reader, wherein the RFID reader is configured to receive a second RFID identifier in response to a second TT device being within a threshold proximity of the RFID reader; and a reporting server configured to generate a product reporting including the first RFID identifier, receive the second RFID identifier from the local system, compare the second RFID identifier to the first RFID identifier of the product reporting, determine from the comparison of the second RFID identifier and the first RFID identifier whether the second RFID identifier matches the first RFID identifier, and in response to the first RFID identifier and the second RFID identifier matching, generate an alert corresponding to the first RFID identifier.

2. The system of claim 1, wherein the NFC-enabled device is further configured to read the first RFID identifier and the location information of the registration server from an NFC tag of the first TT device.

3. The system of claim 2, wherein the NFC-enabled device is further configured to:

retrieve, based on the location information, a registration webpage from the registration server; and display the registration webpage, wherein the registration webpage includes a field entry; and automatically populate the field entry with the first RFID identifier read from the first TT device.

4. The system of claim 3, wherein the field entry is not modifiable.

5. The system of claim 1, wherein:

the registration server further includes a registration data store;

the registration server is further configured to receive the first RFID identifier and registration information, wherein the registration information includes personal information of the registrant;

the association of the first RFID identifier with the registrant includes an association of the first RFID identifier with at least a portion of the personal information of the registrant; and the registration server being configured to store the first product registration includes storing the first product registration in the registration data store.

6. The system of claim 5, wherein the registration server is further configured to:

create a product registration account;

associate the first product registration with the product registration account;

associate one or more second product registrations with the product registration account; and store the product registration account in the registration data store.

7. The system of claim 5, wherein the registration information further comprises a registrant-provided description of a product that includes the first TT device.

8. The system of claim 5, wherein the registration server is further configured to:

determine whether the registration data store includes the first product registration that includes the first RFID identifier; and in response to the registration data store including the first product registration that includes the first RFID identifier, prevent creation of a second product registration that includes the first RFID identifier.

9. The system of claim 1, wherein the location information of the registration server comprises a uniform resource locator (URL).

10. The system of claim 1, wherein the first TT device further comprises a barrier selectably couplable to at least a portion of the first TT device, wherein the barrier, when coupled to the at least a portion of the first TT device, prevents a reading of the first TT device.

11. The system of claim 1, wherein the reporting server is further configured to remove the product reporting from a reporting data store of the reporting server in response to receiving an indication of recovery of a product containing the first TT device.

12. A system, comprising:

a plurality of first track and trace (TT) devices, each first TT device of the plurality of first TT devices including a first radio frequency identification (RFID) identifier, and location information of a registration server, wherein each first RFID identifier is unique among the plurality of first RFID identifiers of the plurality of first TT devices;

an NFC-enabled device configured to send a first RFID identifier of the plurality of first RFID identifiers of the plurality of first TT devices to the registration server using the location information;

the registration server configured to generate and store a plurality of product registrations, wherein each product registration includes an association of a first RFID identifier of the plurality of first RFID identifiers with a registrant of a plurality of registrants;

a local system including an RFID reader, wherein the RFID reader is configured to receive a second RFID identifier in response to a second TT device being within a threshold proximity of the RFID reader; and a reporting server, including a reporting data store configured to store a plurality of product reportings, wherein the reporting server is configured to generate the plurality of product reportings by receiving a first portion of the plurality of first RFID identifiers, creating the plurality of product reportings, wherein each product reporting of the plurality of product reportings includes a first RFID identifier of the first portion of the plurality of first RFID identifiers, and storing the plurality of product reportings in the reporting data store, receive a second RFID identifier from the local system, retrieve, from the reporting data store, the plurality of product reportings, compare the second RFID identifier to a first RFID identifier of at least one product reporting of the plurality of product reportings, determine from the comparison of the second RFID identifier and the first RFID identifier whether the second RFID identifier matches the first RFID identifier, and in response to the second RFID identifier matching the first RFID identifier, generate an alert corresponding to the first RFID identifier.

13. The system of claim 12, wherein:

the registration server further includes a registration data store;

the registration server is further configured to receive a second portion of the plurality of first RFID identifiers, and receive a plurality of registration information, wherein each registration information of the plurality of registration information includes personal information of a registrant of the plurality of registrants;

the association of the first RFID identifier of the plurality of first RFID identifiers with the registrant of the plurality of registrants includes an association of a first RFID identifier of the second portion of the plurality of first RFID identifiers with at least a portion of the personal information of the registrant of the plurality of registrants; and the registration server being configured to store the product registration includes storing the plurality of product registrations in the registration data store.

14. The system of claim 13, wherein the registration server is further configured to:

create a product registration account;

associate a first product registration of the plurality of product registrations with the product registration account;

associate a second product registration of the plurality of product registrations with the product registration account; and store the product registration account in the registration data store.

15. The system of claim 13, wherein each registration information of the plurality of registration information further comprises a registrant-provided description of a product that includes a first TT device of the plurality of first TT devices.

* * * * *